US007556341B2

(12) United States Patent
Nozawa et al.

(10) Patent No.: US 7,556,341 B2
(45) **Date of Patent: *Jul. 7, 2009**

(54) LIQUID JET APPARATUS AND CLEANING METHOD FOR LIQUID JET HEAD

(75) Inventors: Izumi Nozawa, Nagano-Ken (JP); Shuhei Harada, Nagano-Ken (JP); Nobuhito Takahashi, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 126 days.

This patent is subject to a terminal disclaimer.

(21) Appl. No.: 11/602,208

(22) Filed: Nov. 21, 2006

(65) Prior Publication Data

US 2007/0064070 A1 Mar. 22, 2007

Related U.S. Application Data

(60) Division of application No. 11/117,514, filed on Apr. 29, 2005, now Pat. No. 7,159,961, which is a continuation of application No. 10/388,600, filed on Mar. 17, 2003, now Pat. No. 6,974,202.

(30) Foreign Application Priority Data

Mar. 15, 2002 (JP) ..... 2002-71492
Jul. 19, 2002 (JP) ..... 2002-210968

(51) Int. Cl.
*B41J 2/165* (2006.01)

(52) U.S. Cl. ..... 347/29; 347/30; 347/23

(58) Field of Classification Search ..... 347/23–24, 347/29, 30, 31–32
See application file for complete search history.

(56) References Cited

U.S. PATENT DOCUMENTS

| | | | |
|---|---|---|---|
| 5,625,385 | A | 4/1997 | Suzuki |
| 6,312,092 | B1 | 11/2001 | Usui et al. |
| 6,974,202 | B2 | 12/2005 | Nozawa et al. |
| 2002/0085060 | A1 | 7/2002 | Usui et al. |

FOREIGN PATENT DOCUMENTS

| | | | |
|---|---|---|---|
| EP | 1170135 | A1 | 1/2002 |
| JP | 07-290721 | A | 11/1995 |
| JP | 11-348310 | A | 12/1999 |
| JP | 2000-289225 | A | 10/2000 |
| WO | WO 01-53103 | A1 | 1/2002 |

*Primary Examiner*—Lam S Nguyen
(74) *Attorney, Agent, or Firm*—Sughrue Mion, PLLC

(57) ABSTRACT

The apparatus has valve units capable of blocking respectively liquid feed paths connecting a liquid storage unit and a liquid jet head, and control unit. The control unit has a function for executing a pressure reduction step of putting the valve unit corresponding to the kind of liquid to be cleaned into an open state, simultaneously putting the other valve units into a closed state, exhausting a closed space formed by a capping unit with the head and generating a negative pressure state therein, a totally-closing step of switching the valve unit in the open state to the closed state and putting all the valve units into the closed state almost simultaneously with stopping exhausting or immediately before it, and a totally-opening step of putting all the valve units into the open state after a lapse of a predetermined time. Cleaning is executed only for a specific kind of liquid free of obstacles.

4 Claims, 12 Drawing Sheets

LIQUID JET APPARATUS AND CLEANING METHOD FOR LIQUID JET HEAD

This is a divisional of U.S. application Ser. No. 11/117,514 filed Apr. 29, 2005, which is a continuation of U.S. application Ser. No. 10/388,600 filed on Mar. 17, 2003, now U.S. Pat. No. 6,974,202. The entirety of these applications are incorporated herein by reference.

BACKGROUND OF THE INVENTION

1. Field of the Invention

The present invention relates to a liquid jet apparatus for ejecting liquid drops from nozzle openings formed on a liquid jet head and a cleaning method for the liquid jet head of the liquid jet apparatus.

2. Description of the Related Art

As a typical example of a conventional liquid jet apparatus, there is an ink jet recording apparatus having an ink jet recording head for image recording. As other liquid jet apparatus, for example, an apparatus having a color material jet head used for manufacturing color filters of a liquid crystal display, an apparatus having an electrode material (conductive paste) jet head used for forming electrodes of an organic EL or an FED (face emission display), an apparatus having a biological organic substance jet head used for manufacturing biological chips, and an apparatus having a sample jet head as a precise pipette may be cited.

An ink jet recording apparatus as a typical example of a liquid jet apparatus makes comparatively small noise during printing and moreover can form small dots in high density, so that it has been used recently in various types of printing including color printing.

Such an ink jet recording apparatus generally has an ink jet recording head (liquid jet head) which is loaded on a carriage and moves back and forth in the width direction (head scanning direction) of a recording medium such as recording paper and a feed means for moving the recording medium in the direction (medium feed direction) perpendicular to the head scanning direction.

In the ink jet recording apparatus, printing is executed by ejecting ink drops (liquid drops) from the recording head to the recording medium in correspondence with print data. And, the recording head loaded on the carriage is structured so as to eject various colors of ink, for example, black, yellow, cyan, and magenta, thus not only text printing by black ink but also full color printing can be executed by changing the ejection rate of each ink.

Since the aforementioned recording head prints by ejecting ink pressurized in a pressure chamber as ink drops from the nozzle opening toward the recording medium, a problem arises that for example, by increasing of the ink viscosity caused by evaporation of a solvent from the nozzle opening, setting of ink, attachment of dust, moreover inclusion of air bubbles, defective printing is caused.

Therefore, when the nozzle opening of the recording head is clogged or when an ink cartridge is exchanged, the nozzle opening forming face of the recording head is sealed by the capping unit, and ink is sucked and ejected from the nozzle opening by negative pressure from a suction pump (tube pump), thus, generally, the ink jet recording apparatus is provided with a function for executing a cleaning operation for dissolving defective ink ejection due to clogging by ink setting in the nozzle opening or inclusion of air bubbles into the ink feed path.

When the cleaning operation is to be executed, for example, it is effective to generate fast ink flow if possible in the ink flow path from the ink cartridge to the nozzle opening of the recording head and by doing this, together with increased viscosity ink, air bubbles existing in the flow path can be ejected.

However, to increase the flow speed of ink in the cleaning operation, it is necessary to increase the capacity of the suction pump in order to obtain large negative pressure. For that purpose, not only a large-scale pump but also a large-scale motor for driving the pump must be used and an increase in cost and enlargement of the apparatus are unavoidable.

Furthermore, a large amount of ink is ejected from the recording head, so that the life span of the ink cartridge is shortened and a problem arises that it results in an inevitable increase in running cost for a user.

Accordingly, a recording apparatus structured so as to arrange a valve unit capable of opening and closing in the ink feed path from the ink cartridge to the recording head, during the cleaning operation, put the valve unit into the valve closed state, apply negative pressure into the capping unit, at the point of time when the negative pressure in the capping unit increases, open the valve of the valve unit, thereby instantaneously increase the ink flow speed in the recording head is proposed (for example, Japanese Patent Laid-Open Publication No. 101764/1999).

According to the constitution of this conventional proposal, it is considered that without providing a particular suction pump for obtaining large negative pressure, in the neighborhood of the nozzle opening of the recording head, set or increased viscosity ink can be ejected comparatively easily. And, the suction action is performed instantaneously from the nozzle opening, so that it is considered that as a result, the cleaning effect can be produced by ejection of a comparatively small amount of ink.

Further, International Patent Publication WO 01/53103 discloses a method for selectively executing cleaning for the black ink flow path in consideration of that the recovery of black ink during cleaning is lower than that of the other colors of ink.

However, when only the ink feed path of a specific kind of ink is selectively cleaned using the cleaning method for the ink jet recording apparatus and recording head of the aforementioned conventional proposal, there is a possibility that the meniscus of the nozzle opening for a kind of ink not to be cleaned is adversely affected. Namely, even in the nozzle opening for a kind of ink not to be selected, changing of the pressure in the capping unit acts on the meniscus, thus there is the possibility that the meniscus of the non-selected nozzle opening is destroyed by the pressure change.

SUMMARY OF THE INVENTION

The present invention was developed with the foregoing in view and is intended to provide a cleaning method for a liquid jet apparatus and a liquid jet head which can execute cleaning free of obstacles only for a specific kind of liquid.

A liquid jet apparatus according to the present invention comprises: a liquid jet head having nozzle openings through which liquid drops are ejected; a liquid storage unit configured to store plural kinds of liquids to be fed to said liquid jet head; a plurality of valve units capable of respectively closing a plurality of liquid feed paths interconnecting said liquid storage unit and said liquid jet head for each kind of said plural kinds of liquids; a capping unit configured to seal a nozzle forming face of said liquid jet head and form a closed space; a negative pressure generation unit configured to exhaust said closed space formed by said capping unit and generate negative pressure in said closed space; and control means for controlling a switching operation for an open state or a closed state of said plurality of valve units and an exhaust operation for said closed space by said negative pressure generation unit so as to execute cleaning of said liquid jet head, wherein:

said control means has a function for executing a pressure reduction step of putting a valve unit corresponding to a kind of liquid to be cleaned among said plurality of valve units into an open state and simultaneously putting other valve units into a closed state, and in this state, exhausting said closed space by said negative pressure generation unit and generating a negative pressure state, a totally-closing step, after said pressure reduction step, almost simultaneously with stopping exhausting by said negative pressure generation unit or immediately before stopping exhausting, of switching said valve unit in said open state to said closed state and putting all said plurality of valve units into said closed state, and a totally-opening step, after said totally-closing step and after a lapse of a predetermined time, of putting all said plurality of valve units into said open state.

Preferably, said control means further has a function, after said totally-opening step, at a stage that negative pressure remains in said closed space, for executing a totally-re-closing step of putting all said plurality of valve units into said closed state again and a totally-re-opening step, after said totally-re-closing step and after a lapse of a predetermined time, for putting all said plurality of valve units into said open state again.

Preferably, said control means further has a function for executing a totally-sucking step of starting exhausting of said closed space by said negative pressure generation unit almost simultaneously with said totally-re-opening step, thereby sucking all kinds of liquids, and then stopping exhausting by said negative pressure generation unit.

Preferably, said control means further has a function for executing a final totally-closing step of putting all said plurality of valve units into said closed state again after said totally-sucking step and a final totally-opening step of opening all said plurality of valve units again after said final totally-closing step.

Preferably, said control means further has a function, after said totally-opening step, at a stage that said closed space return to almost atmospheric pressure, for executing a totally-sucking step of starting exhausting of said closed space by said negative pressure generation unit, thereby sucking all kinds of liquids, and then stopping exhausting by said negative pressure generation unit.

Preferably, said control means further has a function for executing a final totally-closing step of putting all said plurality of valve units into said closing stage again after said totally-sucking step and a final totally-opening step of opening all said plurality of valve units again after said final totally-closing step.

A liquid jet apparatus according to the present invention comprises: a liquid jet head having nozzle openings through which liquid drops are ejected; a liquid storage unit configured to store plural kinds of liquids to be fed to said liquid jet head; a plurality of valve units capable of respectively closing a plurality of liquid feed paths interconnecting said liquid storage unit and said liquid jet head for each kind of said plural kinds of liquids; a capping unit configured to seal a nozzle forming face of said liquid jet head and form a closed space; a negative pressure generation unit configured to exhaust said closed space formed by said capping unit and generate negative pressure in said closed space; and control means for controlling a switching operation for an open state or a closed state of said plurality of valve units and an exhaust operation for said closed space by said negative pressure generation unit so as to execute cleaning of said liquid jet head, wherein: said control means has a function for executing a pressure reduction step of putting a valve unit corresponding to a kind of liquid to be cleaned among said plurality of valve units into an open state and simultaneously putting other valve units into a closed state, and in this state, exhausting said closed space by said negative pressure generation unit and generating a negative pressure state, and a totally-opening step, after said pressure reduction step, almost simultaneously with stopping exhausting by said negative pressure generation unit, of switching said valve unit in said closed state to said open state and putting all said plurality of valve units into said open state.

Preferably, said control means further has a function for executing a flushing step of flushing said liquid jet head after said totally-opening step.

A liquid jet apparatus according to the present invention comprises: a liquid jet head having nozzle openings through which liquid drops are ejected; a liquid storage unit configured to store plural kinds of liquids to be fed to said liquid jet head; a plurality of valve units capable of respectively closing a plurality of liquid feed paths interconnecting said liquid storage unit and said liquid jet head for each kind of said plural kinds of liquids; a capping unit configured to seal a nozzle forming face of said liquid jet head and form a closed space; a negative pressure generation unit configured to exhaust said closed space formed by said capping unit and generate negative pressure in said closed space; and control means for controlling a switching operation for an open state or a closed state of said plurality of valve units and an exhaust operation for said closed space by said negative pressure generation unit so as to execute cleaning of said liquid jet head, wherein: said control means has a function for executing a pressure reduction step of putting a valve unit corresponding to a kind of liquid to be cleaned among said plurality of valve units into an open state and simultaneously putting other valve units into a closed state, and in this state, exhausting said closed space by said negative pressure generation unit and generating a negative pressure state, and a negative pressure release step, after said pressure reduction step, of stopping exhausting by said negative pressure generation unit and releasing said negative pressure in said closed space with only said valve unit corresponding to said kind of liquid to be cleaned kept in said open state.

Preferably, said control means further has a function, at a stage that said closed space return to almost atmospheric pressure by said negative pressure release step, for executing a totally-opening step of switching said valve unit in said closed state to said open state and putting all said plurality of valve units into said open state.

Preferably, said control means further has a function, after said totally-opening step, with all said plurality of valve units kept in said open state, for executing a totally-sucking step of starting exhausting of said closed space by said negative pressure generation unit, thereby sucking all kinds of liquids, and then stopping exhausting by said negative pressure generation unit.

Preferably, said control means further has a function for executing a flushing step of flushing said liquid jet head after said totally-opening step.

Preferably, said control means further has a function, at a stage that negative pressure remains in said closed space at said negative pressure release step, for executing a totally-opening step of switching said valve unit in said closed state to said open state and putting all said plurality of valve units into said open state.

Preferably, said control means further has a function for executing a totally-sucking step of starting exhausting of said closed space-by said negative pressure generation unit almost simultaneously with said totally-opening step, thereby sucking all kinds of liquids, and then stopping exhausting by said negative pressure generation unit.

A liquid jet apparatus according to the present invention comprises: a liquid jet head having nozzle openings through which liquid drops are ejected; a liquid storage unit configured to store plural kinds of liquids to be fed to said liquid jet head; a plurality of valve units capable of respectively closing a plurality of liquid feed paths interconnecting said liquid storage unit and said liquid jet head for each kind of said plural kinds of liquids; a capping unit configured to seal a nozzle forming face of said liquid jet head and form a closed space; a negative pressure generation unit configured to exhaust said closed space formed by said capping unit and generate negative pressure in said closed space; and control means for controlling a switching operation for an open state or a closed state of said plurality of valve units and an exhaust operation for said closed space by said negative pressure generation unit so as to execute cleaning of said liquid jet head, wherein: said control means has a function for executing a pressure reduction step of putting all said plurality of valve units into said closed state and, in this state, exhausting said closed space by said negative pressure generation unit and generating a negative pressure state, and a negative pressure release step, after said pressure reduction step, of stopping exhausting by said negative pressure generation unit, opening only said valve unit corresponding to a kind of liquid to be cleaned among said plurality of valve units, sucking said liquid, and releasing said negative pressure in said closed space.

Preferably, said control means further has a function, at a stage that said closed space return to almost atmospheric pressure by said negative pressure release step, for executing a totally-opening step of switching said valve unit in said closed state to said open state and putting all said plurality of valve units into said open state.

Preferably, said control means further has a function, with all said plurality of valve units kept in said open state after said totally-opening step, for executing a totally-sucking step of starting exhausting of said closed space by said negative pressure generation unit, thereby sucking all kinds of liquids, and then stopping exhausting by said negative pressure generation unit.

Preferably, said control means further has a function for executing a flushing step of flushing said liquid jet head after said totally-opening step.

Preferably, said control means further has a function, at a stage that negative pressure remains in said closed space at said negative pressure release step, for executing a totally-opening step of switching said valve unit in said closed state to said open state and putting all said plurality of valve units into said open state.

Preferably, said control means further has a function for executing a totally-sucking step of starting exhausting of said closed space by said negative pressure generation unit almost simultaneously with said totally-opening step, thereby sucking all kinds of liquids, and then stopping exhausting by said negative pressure generation unit.

According to the present invention, a cleaning method for a liquid jet head of a liquid jet apparatus including said liquid jet head having nozzle openings through which liquid drops are ejected, a liquid storage unit configured to store plural kinds of liquids to be fed to said liquid jet head, a plurality of valve units capable of respectively closing a plurality of liquid feed paths interconnecting said liquid storage unit and a liquid jet head for each kind of said plural kinds of liquids, a capping unit configured to seal a nozzle forming face of said liquid jet head and form a closed space, and a negative pressure generation unit configured to exhaust said closed space formed by said capping unit and generate negative pressure in said closed space, comprises: a pressure reduction step of putting a valve unit corresponding to a kind of liquid to be cleaned among said plurality of valve units into an open state and simultaneously putting other valve units into a closed state and, in this state, exhausting said closed space by said negative pressure generation unit and generating a negative pressure state; a totally-closing step, after said pressure reduction step, almost simultaneously with stopping exhausting by said negative pressure generation unit or immediately before stopping exhausting, of switching said valve unit in said open state to said closed state and putting all said plurality of valve units into said closed state; and a totally-opening step, after said totally-closing step and after a lapse of a predetermined time, of putting all said plurality of valve units into said open state.

Preferably, the cleaning method for a liquid jet head further comprises: a totally-re-closing step of putting all said plurality of valve units into said closed state again after said totally-opening step at a stage that negative pressure remains in said closed space; and a totally-re-opening step of putting all said plurality of valve units into said open state again after said totally-re-closing step and after a lapse of a predetermined time.

Preferably, the cleaning method for a liquid jet head further comprises: a totally-sucking step of starting exhausting of said closed space by said negative pressure generation unit almost simultaneously with said totally-re-opening step, there by sucking all kinds of liquids, and then stopping exhausting by said negative pressure generation unit.

Preferably, the cleaning method for a liquid jet head further comprises: a final totally-closing step of putting all said plurality of valve units into said closed state again after said totally-sucking step; and a final totally-opening step of opening all said plurality of valve units again after said final-totally-closing step.

Preferably, the cleaning method for a liquid jet head further comprises: a totally-sucking step of, after said totally-opening step, at a state that said closed space return to almost atmospheric pressure, starting exhausting of said closed space by said negative pressure generation unit, thereby sucking all kinds of liquids, and then stopping exhausting by said negative pressure generation unit.

Preferably, the cleaning method for a liquid jet head further comprises: a final totally-closing step of putting all said plurality of valve units into said closed state again after said totally-sucking step; and a final totally-opening step of opening all said plurality of valve units again after said final totally-closing step.

According to the present invention, a cleaning method for a liquid jet head of a liquid jet apparatus including said liquid jet head having nozzle openings through which liquid drops are ejected, a liquid storage unit configured to store plural kinds of liquids to be fed to said liquid jet head, a plurality of valve units capable of respectively closing a plurality of liquid feed paths interconnecting said liquid storage unit and a liquid jet head for each kind of said plural kinds of liquids, a capping unit configured to seal a nozzle forming face of said liquid jet head and form a closed space, and a negative pressure generation unit configured to exhaust said closed space formed by said capping unit and generate negative pressure in said closed space, comprises: a pressure reduction step of putting a valve unit corresponding to a kind of liquid to be cleaned among said plurality of valve units into an open state and simultaneously putting other valve units into a closed state, and in this state, exhausting said closed space by said negative pressure generation unit and generating a negative pressure state; and a totally-opening step, after said pressure reduction step, almost simultaneously with stopping exhausting by said negative pressure generation unit, of switching said valve unit in said closed state to said open state and putting all said plurality of valve units into said open state.

Preferably, the cleaning method for a liquid jet head further comprises: a flushing step of flushing said liquid jet head after said totally-opening step.

According to the present invention, a cleaning method for a liquid jet head of a liquid jet apparatus including said liquid jet head having nozzle openings through which liquid drops are ejected, a liquid storage unit configured to store plural kinds of liquids to be fed to said liquid jet head, a plurality of valve units capable of respectively closing a plurality of liquid feed paths interconnecting said liquid storage unit and a liquid jet head for each kind of said plural kinds of liquids, a capping unit configured to seal a nozzle forming face of said liquid jet head and form a closed space, and a negative pressure generation unit configured to exhaust said closed space formed by said capping unit and generate negative pressure in said closed space, comprises: a pressure reduction step of putting a valve unit corresponding to a kind of liquid to be cleaned among said plurality of valve units into an open state and simultaneously putting other valve units into a closed state, and in this state, exhausting said closed space by said negative pressure generation unit and generating a negative pressure state; and a negative pressure release step, after said pressure reduction step, of stopping exhausting by said negative pressure generation unit and releasing said negative pressure in said closed space with only said valve unit corresponding to said kind of liquid to be cleaned kept in said open state.

Preferably, the cleaning method for a liquid jet head further comprises: a totally-opening step of switching said valve unit in said closed state to said open state and putting all said plurality of valve units into said open state at a stage that said closed space return to almost atmospheric pressure at said negative release step.

Preferably, the cleaning method for a liquid jet head further comprises: a totally-sucking step of, after said totally-opening step, starting exhausting of said closed space by said negative pressure generation unit with all said plurality of valve units kept in said open state, thereby sucking all kinds of liquids, and then stopping exhausting by said negative pressure generation unit.

Preferably, the cleaning method for a liquid jet head further comprises: a flushing step of flushing said liquid jet head after said totally-opening step.

Preferably, the cleaning method for a liquid jet head further comprises: a totally-opening step of, at a stage that negative pressure remains in said closed space at said negative pressure release step, switching said valve unit in said closed state to said open state and putting all said plurality of valve units into said open state.

Preferably, the cleaning method for a liquid jet head further comprises: a totally-sucking step of starting exhausting of said closed space by said negative pressure generation unit almost simultaneously with said totally-opening step, thereby sucking all kinds of liquids, and then stopping exhausting by said negative pressure generation unit.

According to the present invention, a cleaning method for a liquid jet head of a liquid jet apparatus including said liquid jet head having nozzle openings through which liquid drops are ejected, a liquid storage unit configured to store plural kinds of liquids to be fed to said liquid jet head, a plurality of valve units capable of respectively closing a plurality of liquid feed paths interconnecting said liquid storage unit and a liquid jet head for each kind of said plural kinds of liquids, a capping unit configured to seal a nozzle forming face of said liquid jet head and form a closed space, and a negative pressure generation unit configured to exhaust said closed space formed by said capping unit and generate negative pressure in said closed space, comprises: a pressure reduction step of putting all said plurality of valve units into a closed state, and in this state, exhausting said closed space by said negative pressure generation unit and generating a negative pressure state; and a negative pressure release step, after said pressure reduction step, of stopping exhausting by said negative pressure generation unit, opening only a valve unit corresponding to a kind of liquid to be cleaned among said plurality of valve units, sucking said liquid, and releasing said negative pressure in said closed space.

Preferably, the cleaning method for a liquid jet head further comprises: a totally-opening step of, at a stage that said closed space return to almost atmospheric pressure at said negative pressure release step, switching said valve unit in said closed state to said open state and putting all said plurality of valve units into said open state.

Preferably, the cleaning method for a liquid jet head further comprises: a totally-sucking step of, after said totally-opening step, starting exhausting of said closed space by said negative pressure generation unit with all said plurality of valve units kept in said open state, thereby sucking all kinds of liquids, and then stopping exhausting by said negative pressure generation unit.

Preferably, the cleaning method for a liquid jet head further comprises: a flushing step of flushing said liquid jet head after said totally-opening step.

Preferably, the cleaning method for a liquid jet head further comprises: a totally-opening step of, at a stage that negative pressure remains in said closed space at said negative pressure release step, switching said valve unit in said closed state to said open state and putting all said plurality of valve units into said open state.

Preferably, the cleaning method for a liquid jet head further comprises: a totally-sucking step of starting exhausting of said closed space by said negative pressure generation unit almost simultaneously with said totally opening step, thereby sucking all kinds of liquids, and then stopping exhausting by said negative pressure generation unit.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

The ink jet recording apparatus as an embodiment of the liquid jet apparatus of the present invention and the cleaning method for the recording head (liquid jet head) of the apparatus will be explained hereunder with reference to the accompanying drawings.

The ink jet recording apparatus of this embodiment has an ink jet recording head including pressure generation elements installed in correspondence with pressure chambers. The pressure chambers are connected to a plurality of nozzle openings, respectively. The pressure generation elements are driven to change the pressure of ink in the respective pressure chambers, thereby ejecting ink drops (liquid drops) from the respective nozzle openings. As a pressure generation element, for example, a piezo-vibrator can be used.

Figure 1:
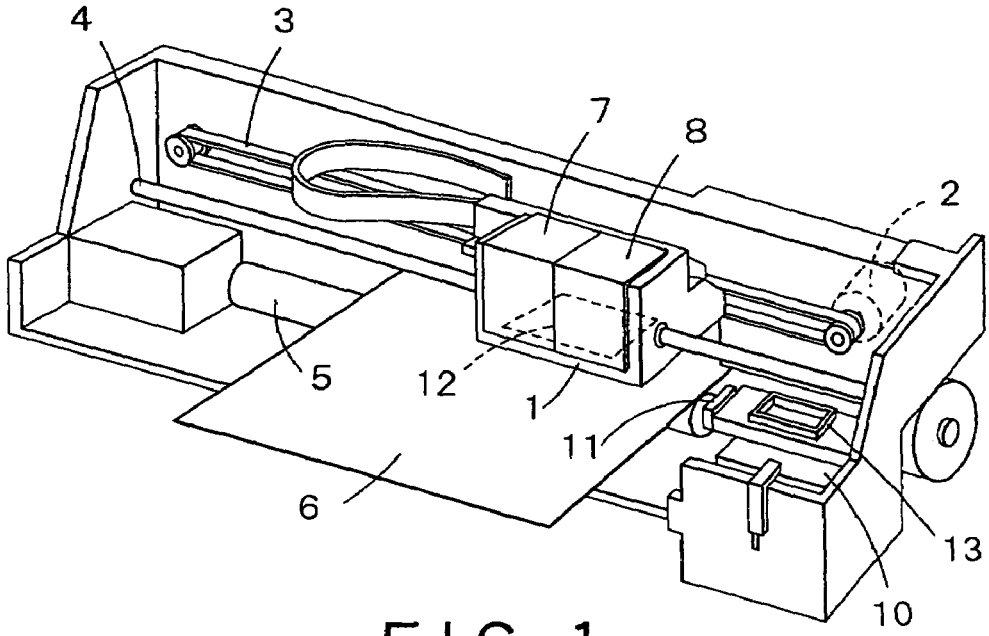
FIG. 1 is a perspective view showing the schematic constitution of an ink jet recording apparatus of an embodiment of the liquid jet apparatus of the present invention.
Figure 2:
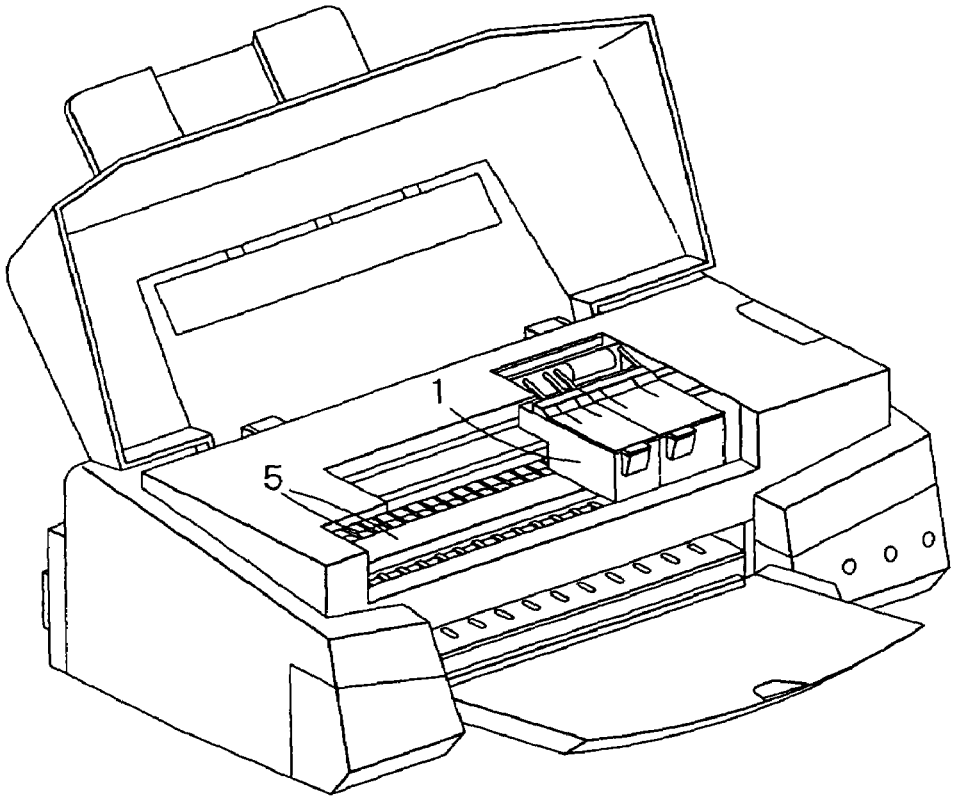
FIG. 2 is another perspective view showing the schematic constitution of an ink jet recording apparatus of an embodiment of the liquid jet apparatus of the present invention.

FIGS. 1 and 2 are perspective views showing a schematic constitution of the ink jet recording apparatus of this embodiment. Numeral 1 shown in FIG. 1 indicates a carriage and the carriage 1 is structured so as to be guided by a guide member 4 via a timing belt 3 driven by a carriage motor 2 and move back and forth in the axial direction of a platen 5. The platen 5 supports recording paper 6 (a kind of recording medium) from the back thereof and specifies the position of the recording paper 6 with respect to a recording head 12.

The carriage 1, the carriage motor 2, the timing belt 3, and the guide member 4 constitute the carriage mechanism for scanning the ink jet recording head (liquid jet head) 12 in the head scanning direction together with the carriage 1.

The recording head 12 is loaded on the side opposite to the recording paper 6 of the carriage 1. Further, on the carriage 1, ink cartridges (ink storage units) 7 and 8 for feeding ink to the recording head 12 are mounted in a removable state. The ink cartridge 7 stores black ink and the ink cartridge 8 stores color ink (cyan, magenta, yellow).

In the home position (on the right side of FIG. 1) which is a non-printing area of the ink jet recording apparatus, a cap member 13 is arranged and the cap member 13 is structured so as to be pressed against the nozzle forming face of the recording head 12 when the recording head 12 loaded on the carriage 1 moves to the home position and form a closed space between the cap member 13 and the nozzle forming face. And, under the cap member 13, a suction pump 10 for giving negative pressure to the closed space formed by the cap member 13 is arranged.

In the neighborhood of the cap member 13 on the printing area side, a wiping means 11 having an elastic plate such as rubber is arranged so as to move, for example, in the horizontal direction to the moving track of the recording head 12 and is structured so as to wipe the nozzle forming face of the recording head 12 as required when the carriage 1 moves over the wiping means 11.

The ink jet recording apparatus of this embodiment further has a medium feed mechanism for intermittently feeding the recording paper 6 to be printed (recorded) by the recording head 12 in the medium feeding direction perpendicular to the head scanning direction.

Next, by referring to FIG. 3, a plurality of valve units capable of blocking respectively a plurality of ink feed paths connecting the ink cartridges 7 and 8 to the recording head 12 for each kind of a plurality of kinds of ink will be explained.

Figure 3:
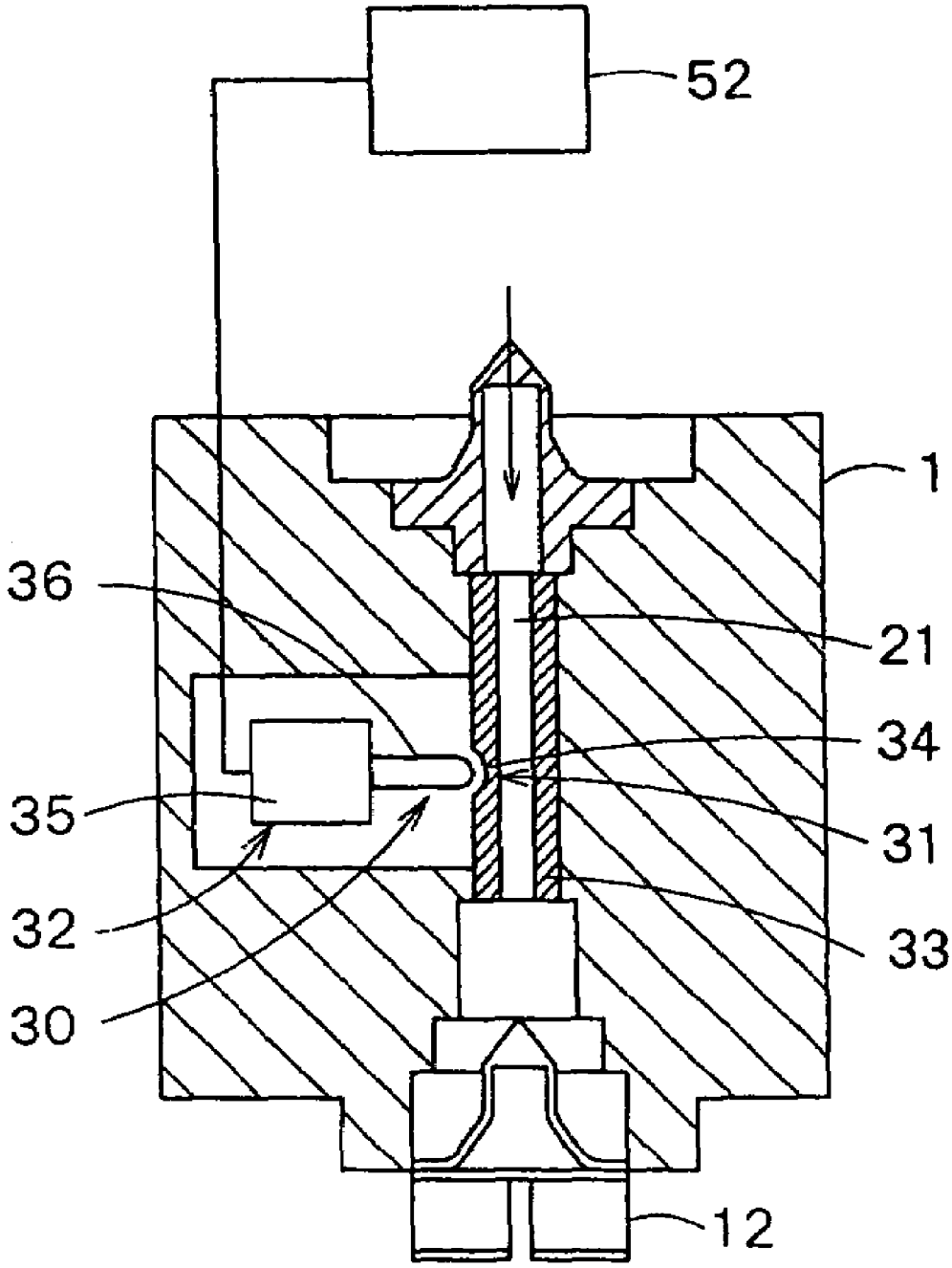
FIG. 3 is a drawing showing the valve mechanism and drive mechanism of the ink jet recording apparatus shown in FIGS. 1 and 2 and the periphery thereof which are enlarged.

As shown in FIG. 3, a valve unit 30 has a valve mechanism 31 and a drive mechanism 32 therefor, and the valve mechanism 32 is installed in the carriage 1 and includes a tube 33 forming a part of an ink feed path 21, and a flexible thin part 34 is formed in the middle of the tube 33. The drive mechanism 32 has an actuator 35 and the actuator 35 includes a compression rod 36 in a movable state. The compression rod 36 is arranged opposite to the flexible thin part 34 of the tube 33. When the actuator 35 is driven and the compression rod 36 moves forward, the flexible thin part 34 of the tube 33 is compressed and deformed inward, thus the ink feed path 21 is blocked or the flow path resistance is increased. In the carriage 1, the ink feed path 21 is formed for each kind of liquid and the valve unit 30 is installed in each of a plurality of ink feed paths 21.

Figure 4:
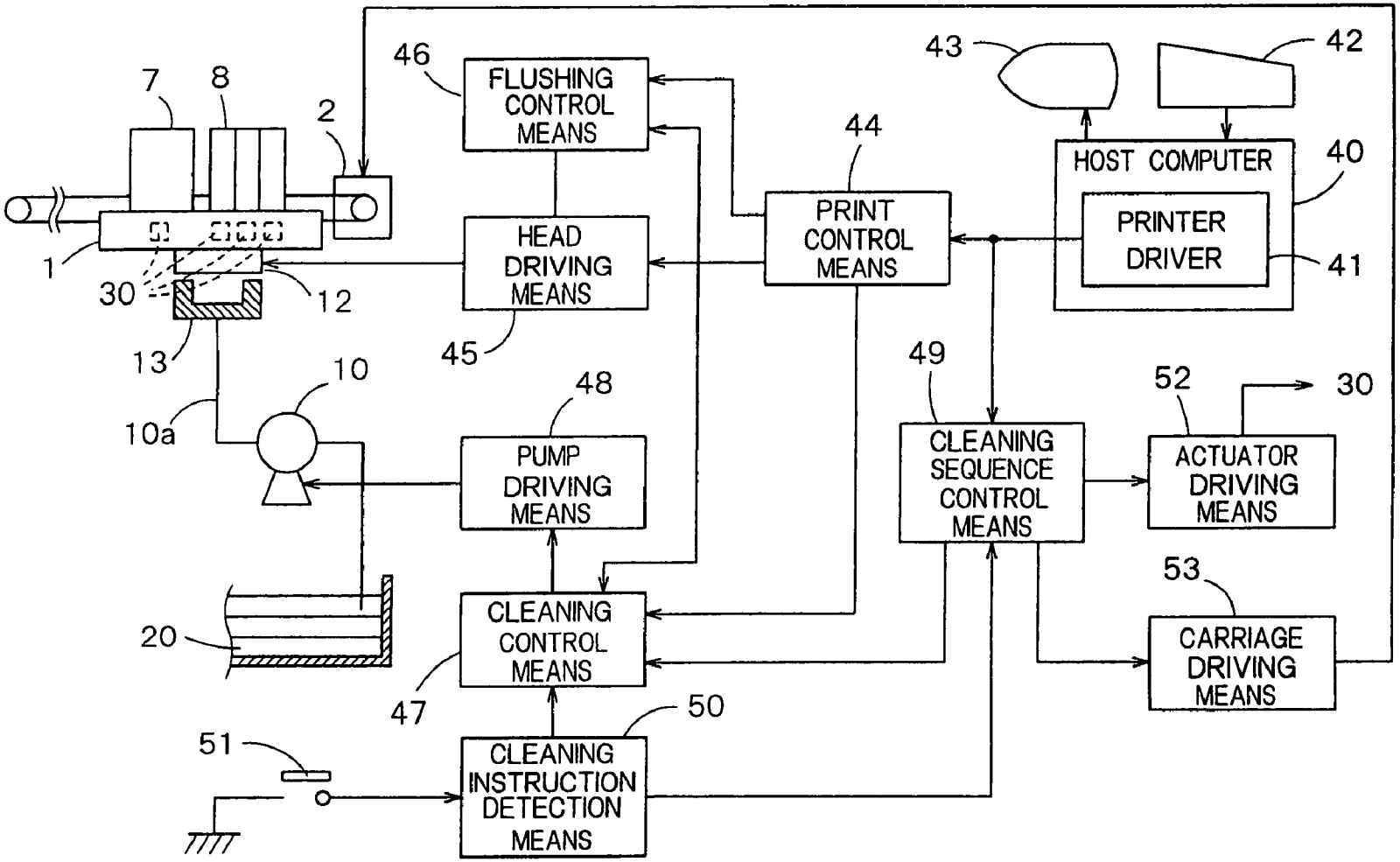
FIG. 4 is a block diagram showing the control circuit for controlling the cleaning operation for the recording head of the ink jet recording apparatus shown in FIGS. 1 and 2.

FIG. 4 is a block diagram showing the control circuit for controlling the cleaning operation of the ink jet recording apparatus of this embodiment. As shown in FIG. 4, one end of the tube 10*a* constituting the suction pump 10 as a negative pressure generation unit is connected to the cap member 13 and the other end is connected to a waste liquid tank 20. An ink waste liquid ejected into the inner space of the cap member 13 can be drained in the waste liquid tank 20 via the suction pump 10.

Numeral 40 shown in FIG. 4 indicates a host computer and in the host computer 40, a printer driver 41 is loaded. And, on the utility of the printer driver 41, it is structured so as to input, using an input device 42 and a display 43, the known paper size, selection of monochromatic or color print, selection of a recording mode, data such as a font, and a print instruction.

Furthermore, the ink jet recording apparatus of this embodiment is structured so as to input the operation timing of each actuator 35 of the plurality of valve units 30 arranged in the ink cartridges 7 and 8 using the input device 4 and the display 43.

By input of a print instruction of the input device 42, it is structured so as to send print data to a print control means 44 loaded on the recording apparatus from the printer driver 41. The print control means 44 has a function for generating bit map data on the basis of the print data transferred from the host computer 40, generating a drive signal by a head driving means 45 on the basis of the bit map data, and ejecting ink from the recording head 12.

The head driving means 45 is structured, in addition to the drive signal based on the print data, so as to receive a flushing instruction signal from a flushing control means 46 and output a drive signal for the flushing operation to the recording head 12.

Further, the control circuit of this embodiment has a cleaning control means 47 and is structured so as to operate a pump driving means 48 by an instruction from the cleaning control means 47 and drive and control the suction pump 10. Further, the cleaning control means 47 is structured so as to feed a cleaning instruction signal from the print control means 44, a cleaning sequence control means 49, and a cleaning instruction detection means 50.

Further, an operation switch 51 is connected to the cleaning instruction detection means 50, which is structured, when a user performs, for example, a push operation for the switch 51, so as to activate the cleaning control means 47 via the detection means 50 and execute the cleaning operation by a manual operation. Further, it is structured, by operating the input device 42 of the host computer 40, so as to activate the cleaning control means 47 via the print control means 44 and manually execute the cleaning operation.

On the other hand, the cleaning sequence control means 49 is structured so as to receive an instruction signal from the host computer 40 and the cleaning instruction detection means 50 and send a control signal to an actuator driving means 52 and a carriage driving means 53.

And, the actuator driving means 52 sends a drive signal to each actuator 35 of the valve units 30 installed in the carriage 1, makes the compression rod 36 of the actuator 35 move forward, deforms the flexible thin part 34 of the tube 33 inward, thereby blocks the desired ink feed path 21 among the plurality of ink feed paths 21, or increases the flow path resistance, or opens the ink feed path 21 by the inverse operation.

Further, the carriage driving means 53 drives the carriage motor 2 upon receipt of an instruction from the cleaning sequence control means 49 and moves the recording head 12 up to the home position for sealing the nozzle forming face of the recording head 12 by the cap member 13.

Next, various cleaning methods of the recording head 12 will be explained by referring to FIGS. 5 to 22. Further, the various cleaning methods to be explained hereunder is a case of cleaning the nozzle opening and ink flow path corresponding to cyan (C) among the liquid kinds of black (BK), cyan (C), magenta (M), and yellow (Y), as an example.

Figure 5:
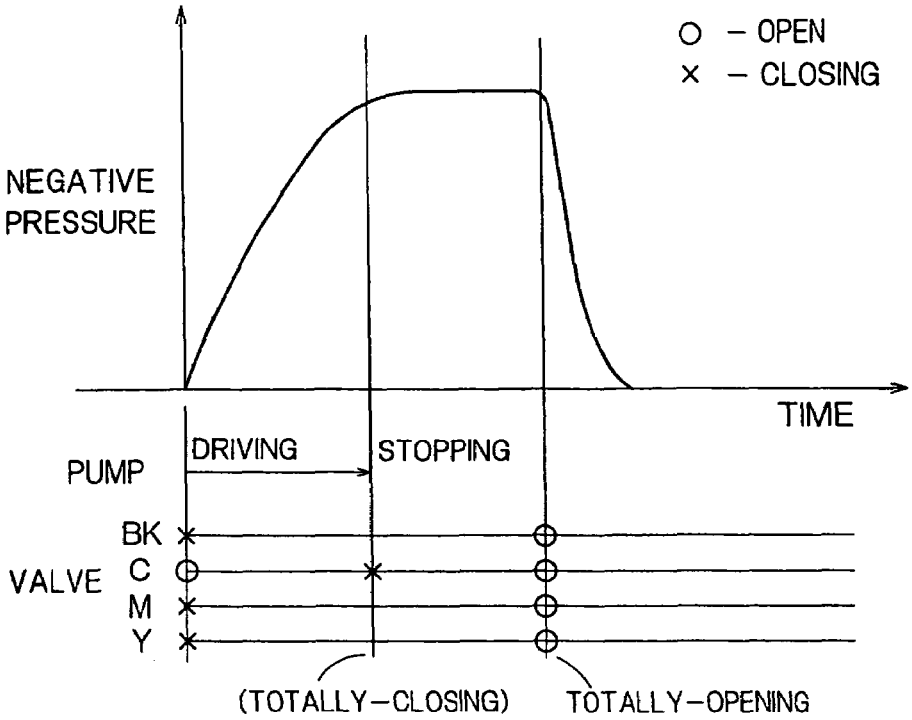
FIG. 5 is a drawing for explaining the first cleaning method for the recording head of the ink jet recording apparatus shown in FIGS. 1 and 2.

FIG. 5 is a graph for explaining the first cleaning method, and the transverse axis indicates the time, and the ordinate axis indicates the magnitude of the negative pressure in the cap member 13 sealing the recording head 12 (hereinafter, the same may be said with FIGS. 6 to 22).

In a state that the nozzle forming face of the recording head 12 is sealed by the cap member 13, the actuators 35 of the valve units 30 corresponding to black, magenta, and yellow ink are driven using the actuator driving means 52 and the ink feed paths 21 corresponding to these ink kinds are closed. By doing this, only the ink feed path 21 corresponding to cyan ink is put into the open state.

Only the ink feed path 21 corresponding to cyan ink is put into the open state like this, and an instruction from the cleaning control means 47 is sent, thus the pump driving means 48 is operated, and the suction pump 10 is driven, and the cap member 13 is sucked and exhausted (the pressure reduction step).

And, at the point of time when the negative pressure in the cap member 13 reaches a predetermined level or at the point of time when a predetermined time elapses after start of the suction pump 10, the cleaning control means 4 sends an instruction to the pump driving means 48, thereby stops the suction pump 10, and then stops the exhaust. Almost simultaneously with the exhaust stop or immediately before the exhaust stop, the valve unit 30 for cyan ink in the open state is switched to the closed state, thus the plurality of valve units 30 are all put into the closed state (the totally-closing step).

When a predetermined time elapses after end of the totally-closing step, the plurality of valve units 30 are all put into the open state (the totally-opening step). By doing this, the inner pressure of the cap member 13 returns to the atmospheric pressure.

According to the first cleaning method, the cap member 13 is exhausted when the valve unit 30 only for the ink kind (cyan) to be cleaned is in the open state, and almost simultaneously with exhaust stop or immediately before exhaust stop, the valve unit 30 in the open state is closed, and after a lapse of the predetermined time, all the valve units 30 are opened, so that large negative pressure can be obtained without enlarging the pump, and the suction amount of ink other than the color to be cleaned is suppressed to a small amount, thus a sufficient cleaning effect can be obtained only by a comparatively small amount of ink, and the nozzles of the ink kinds not to be cleaned can be prevented from pull-in of ink or air.

Figure 6:
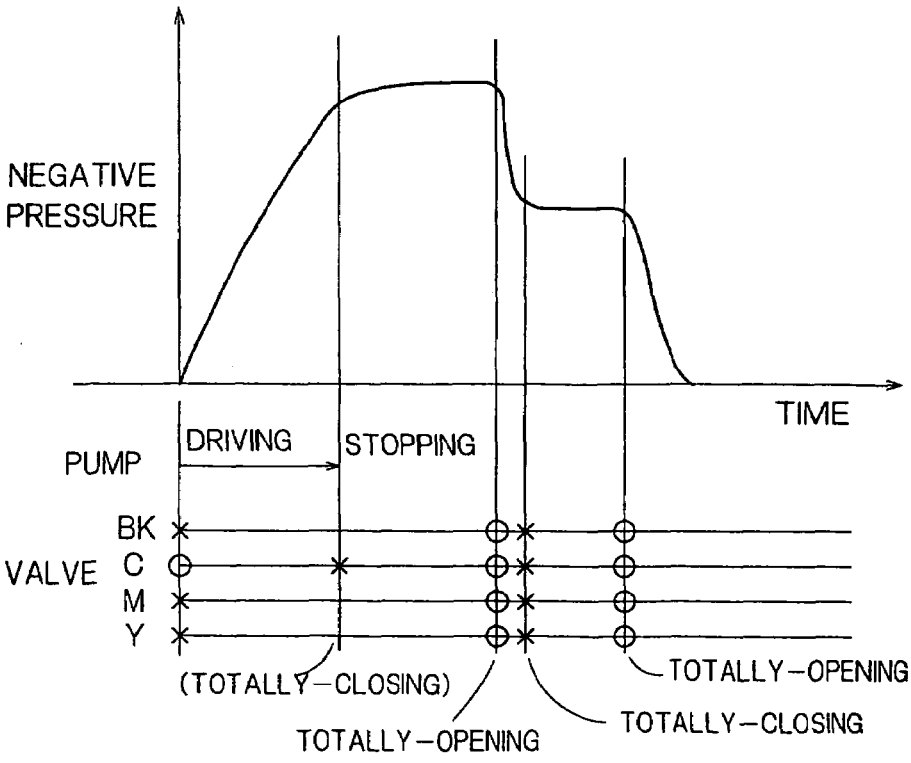
FIG. 6 is a drawing for explaining the second cleaning method for the recording head of the ink jet recording apparatus shown in FIGS. 1 and 2.

Next, the second cleaning method will be explained by referring to FIG. 6. The second cleaning method, after the totally-opening step by the first cleaning method shown in FIG. 5, at a stage that negative pressure remains in the closed space formed by the cap member 13, puts the plurality of valve units 30 all into the closed state again (the totally-re-closing step). And, when a predetermined time elapses after the totally-re-closing step, the method puts the plurality of valve units 30 all into the open state again (the totally-re-opening step).

According to the second cleaning method, all the valve units 30 are closed once (the totally-re-closing step) after the totally-opening step, so that the same effect as that of the first cleaning method is obtained and the nozzles of the ink kinds not to be cleaned can be prevented more surely from pull-in of ink or air.

Figure 7:
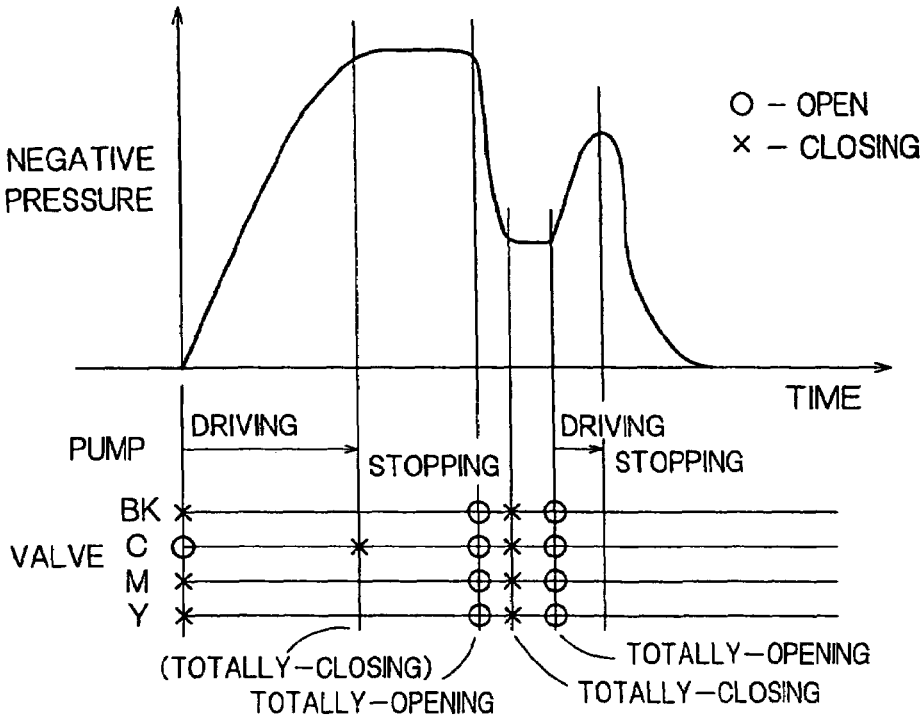
FIG. 7 is a drawing for explaining the third cleaning method for the recording head of the ink jet recording apparatus shown in FIGS. 1 and 2.

Next, the third cleaning method will be explained by referring to FIG. 7. The third cleaning method drives the suction pump 10 almost simultaneously with the totally-opening step in the second cleaning method shown in FIG. 6, exhausts the closed space formed by the cap member 13, thereby sucks all the kinds of ink, and then stops the suction pump 10 (the totally-sucking step).

The third cleaning method also can obtain the same effect as that of the aforementioned cleaning methods.

Figure 8:
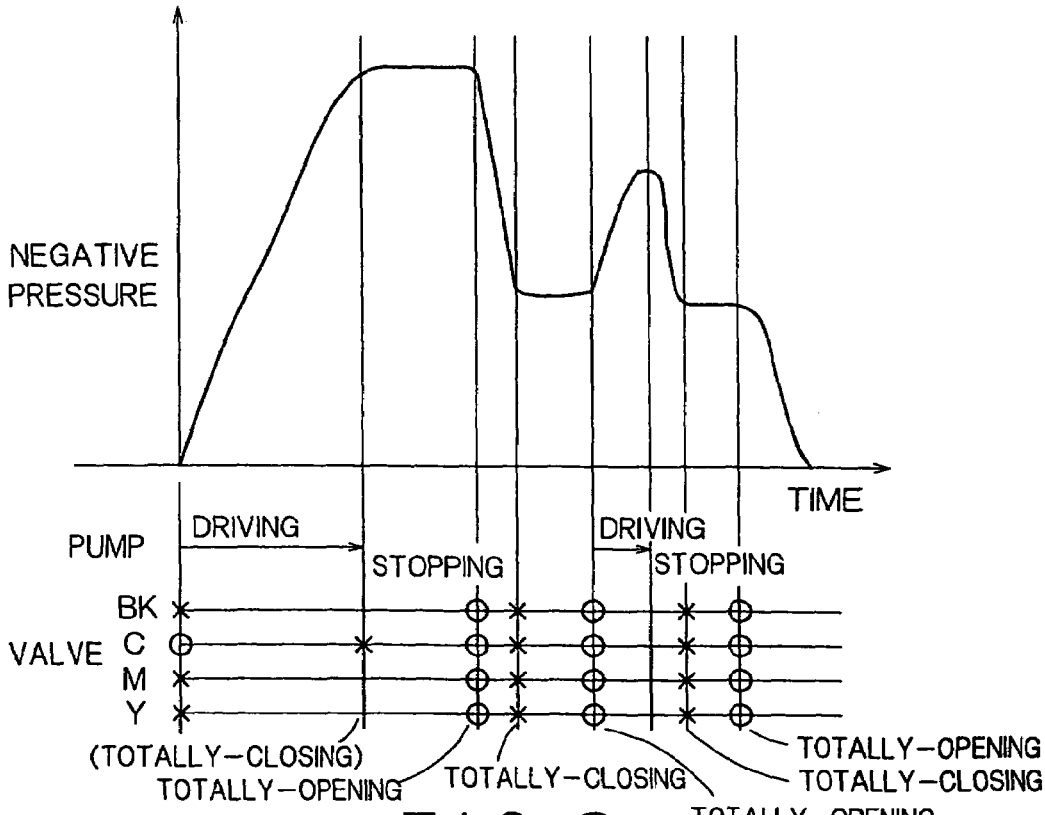
FIG. 8 is a drawing for explaining the fourth cleaning method for the recording head of the ink jet recording apparatus shown in FIGS. 1 and 2.

Next, the fourth cleaning method will be explained by referring to FIG. 8. The fourth cleaning method puts the plurality of valve units 30 all into the closed state again after the totally-sucking step shown in FIG. 7 (the final totally-closing step). And, the method opens all the plurality of valve units 30 again after the final totally-closing step (the final totally-opening step).

The fourth cleaning method also can obtain the same effect as that of the aforementioned cleaning methods.

Figure 9:
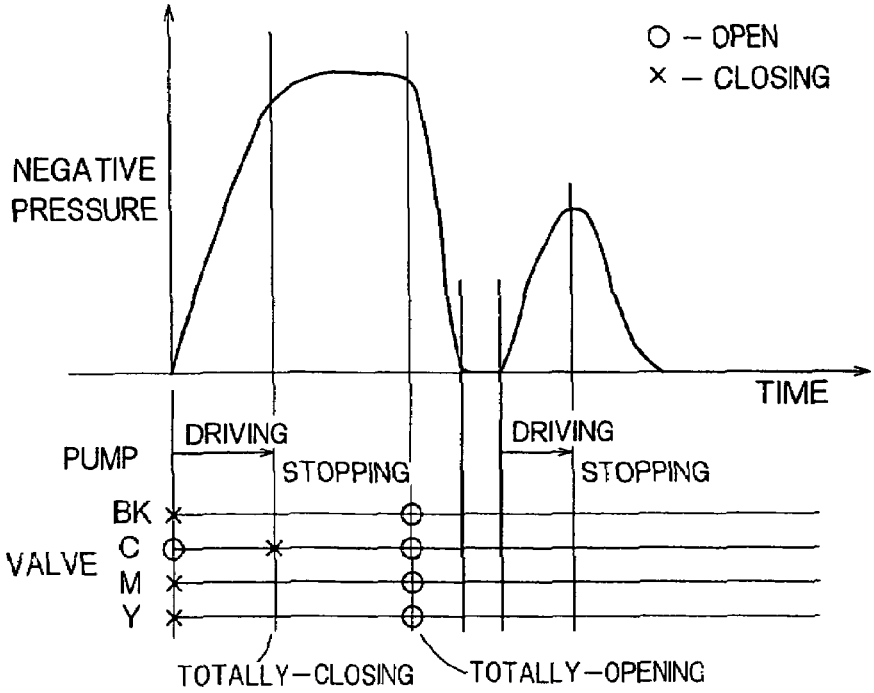
FIG. 9 is a drawing for explaining the fifth cleaning method for the recording head of the ink jet recording apparatus shown in FIGS. 1 and 2.

Next, the fifth cleaning method will be explained by referring to FIG. 9. The fifth cleaning method, after the totally-opening step by the first cleaning method shown in FIG. 5, at a stage that the closed space formed by the cap member 13 returns to almost the atmospheric pressure, drives the suction pump 10, exhausts the closed space, thereby sucks all kinds of ink, and then stops the suction pump 10 (the totally-sucking step).

The fifth cleaning method also can obtain the same effect as that of the aforementioned cleaning methods.

Figure 10:
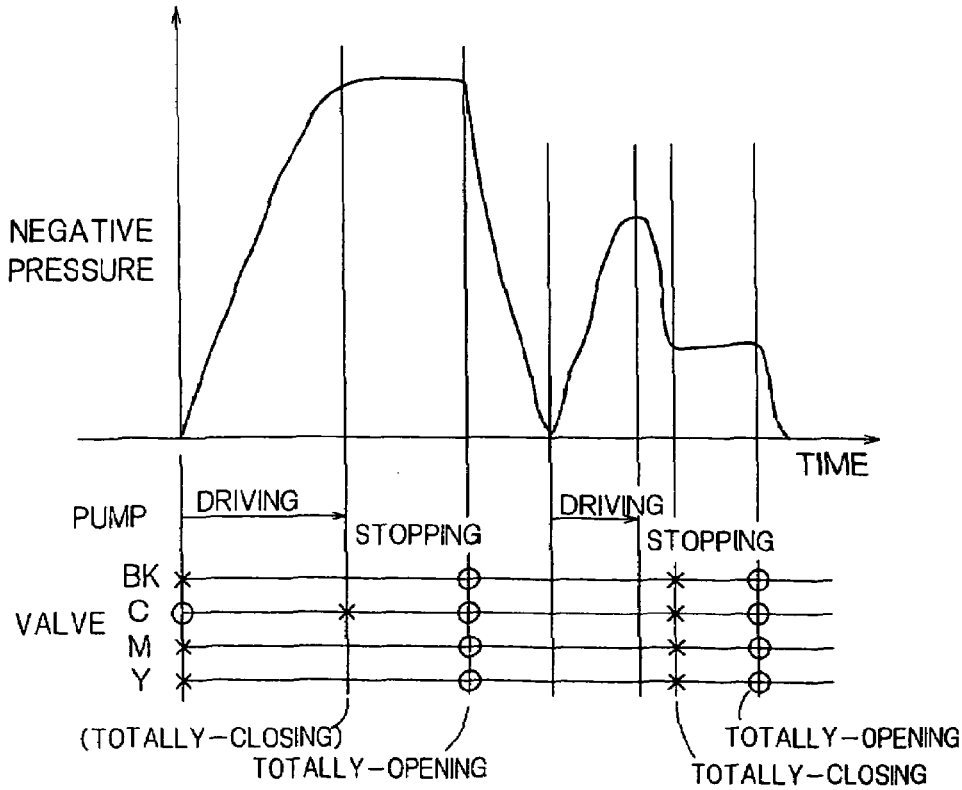
FIG. 10 is a drawing for explaining the sixth cleaning method for the recording head of the ink jet recording apparatus shown in FIGS. 1 and 2.

Next, the sixth cleaning method will be explained by referring to FIG. 10. The sixth cleaning method puts the plurality of valve units 30 all into the closed state again after the totally-sucking step by the fifth cleaning method shown in FIG. 9 (the final totally-closing step). And, the method opens all the plurality of valve units 30 again after the final totally-closing step (the final totally-opening step).

The sixth cleaning method also can obtain the same effect as that of the aforementioned cleaning methods.

Figure 11:
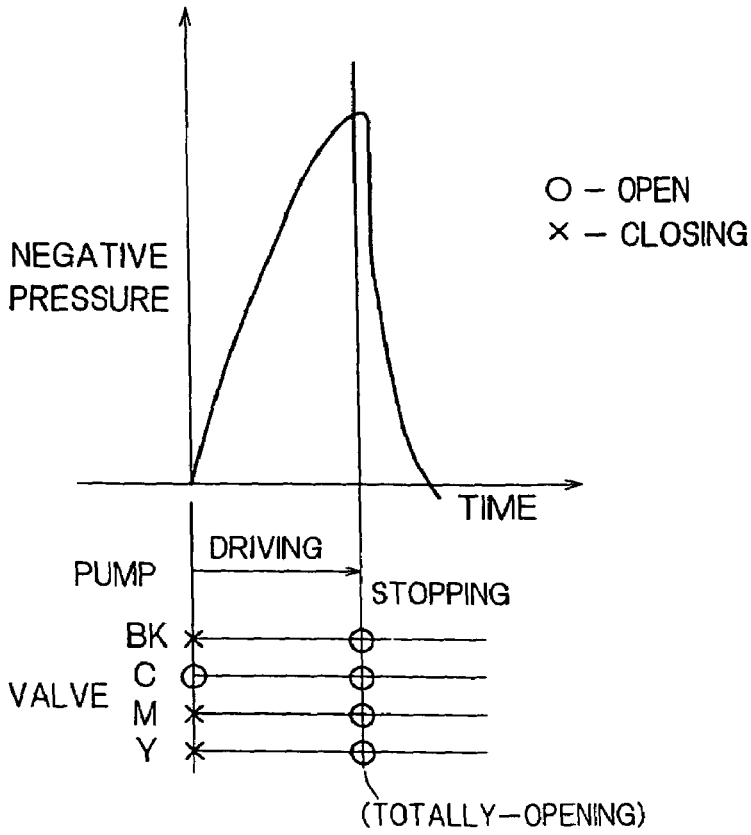
FIG. 11 is a drawing for explaining the seventh cleaning method for the recording head of the ink jet recording apparatus shown in FIGS. 1 and 2.

Next, the seventh cleaning method will be explained by referring to FIG. 11.

In a state that the nozzle forming face of the recording head 12 is sealed by the cap member 13, using the actuator driving means 52, the actuators 35 of the valve units 30 corresponding to black, magenta, and yellow ink are driven and the ink feed paths 21 corresponding to these ink kinds are closed. By doing this, only the ink feed path 21 corresponding to cyan ink is set in the open state.

Only the ink feed path 21 corresponding to cyan ink is put into the open state like this, and an instruction from the cleaning control means 47 is sent, thus the pump driving means 48 is operated, and the suction pump 10 is driven, and the cap member 13 is sucked and exhausted (the pressure reduction step).

And, at the point of time when the negative pressure in the cap member 13 reaches a predetermined level or at the point of time when a predetermined time elapses after start of the suction pump 10, the cleaning control means 4 sends an instruction to the pump driving means 48, thereby stops the suction pump 10, and then stops the exhaust. Almost simultaneously with the exhaust stop or immediately before the exhaust stop, the valve units 30 for black, magenta, and yellow ink in the closed state are switched to the open state, thus the plurality of valve units 30 are all put into the open state (the totally-opening step).

According to the seventh cleaning method, the cap member 13 is exhausted when the valve unit 30 only for the ink kind (cyan) to be cleaned is in the open state and almost simultaneously with exhaust stop, the valve unit 30 in the closed state is opened, so that large negative pressure can be obtained without enlarging the pump, and the suction amount of ink other than the color to be cleaned is suppressed to a small amount, thus a sufficient cleaning effect can be obtained only by a comparatively small amount of ink, and the nozzles of the ink kinds not to be cleaned can be prevented from pull-in of ink or air.

Figure 12:
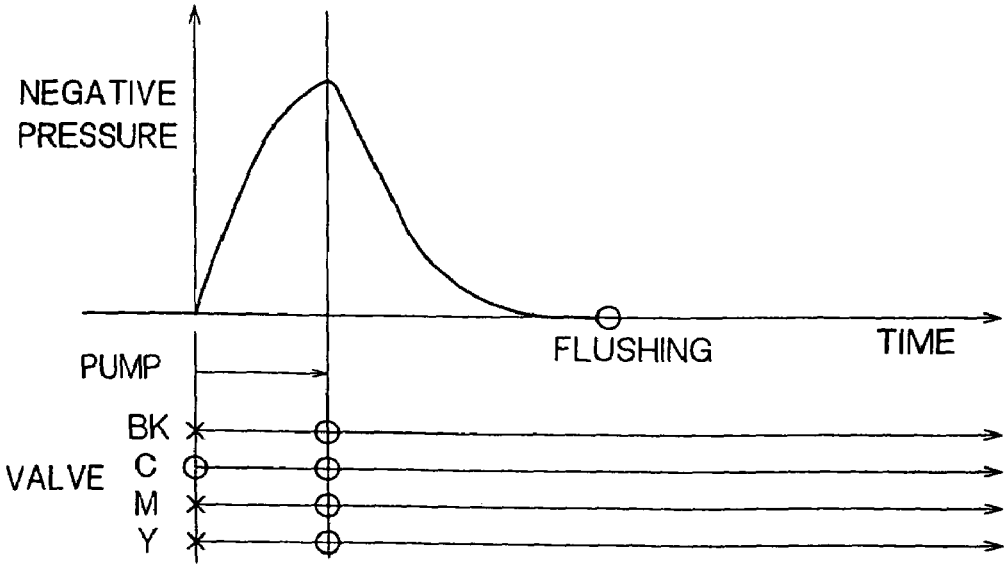
FIG. 12 is a drawing for explaining the eighth cleaning method for the recording head of the ink jet recording apparatus shown in FIGS. 1 and 2.

Next, the eighth cleaning method will be explained by referring to FIG. 12. The eighth cleaning method, after the totally-opening step by the seventh cleaning method shown in FIG. 11, sends a flushing instruction signal from the flushing control means 46 to the head driving means 45 and flushes the recording head 12 (the flushing step).

According to the eighth cleaning method, even if the meniscus of the nozzle opening of the recording head 12 is destroyed and mixed with colors at the totally-opening step, the meniscus is recovered by the flushing step, thus the color mixture can be prevented.

Figure 13:
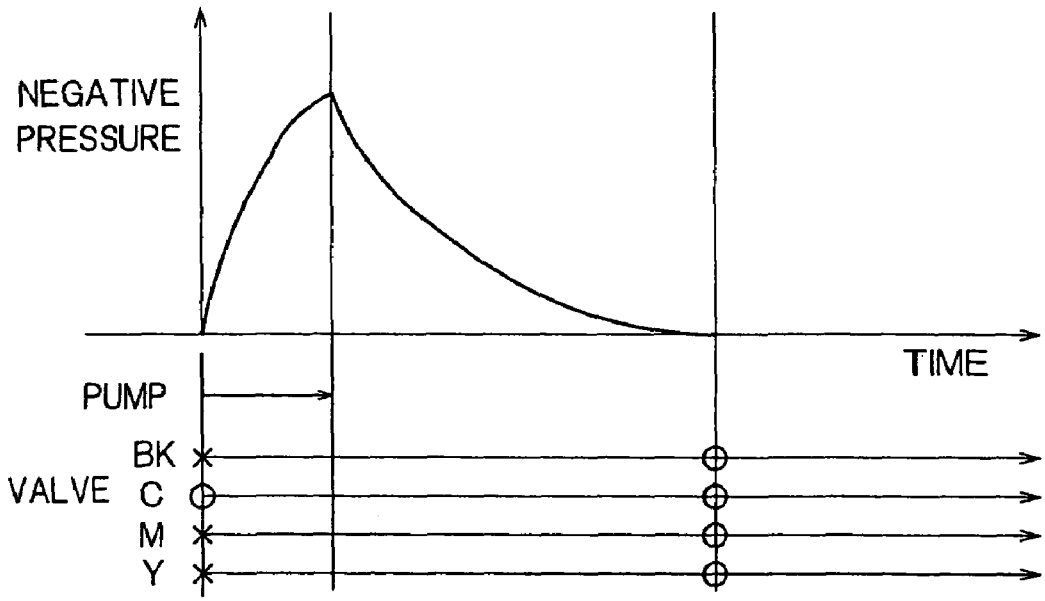
FIG. 13 is a drawing for explaining the ninth cleaning method for the recording head of the ink jet recording apparatus shown in FIGS. 1 and 2.

Next, the ninth cleaning method will be explained by referring to FIG. 13.

In a state that the nozzle forming face of the recording head 12 is sealed by the cap member 13, the ninth cleaning method, using the actuator driving means 52, drives the actuators 35 of the valve units 30 corresponding to black, magenta, and yellow ink and closes the ink feed paths 21 corresponding to these ink kinds. By doing this, only the ink feed path 21 corresponding to cyan ink is set in the open state.

The cleaning method puts only the ink feed path 21 corresponding to cyan ink into the open state like this, sends an instruction from the cleaning control means 47, thereby operates the pump driving means 48, drives the suction pump 10, and sucks and exhausts the cap member 13 (the pressure reduction step).

And, at the point of time when the negative pressure in the cap member 13 reaches a predetermined level or at the point of time when a predetermined time elapses after start of the suction pump 10, the cleaning control means 4 sends an instruction to the pump driving means 48, thereby stops the suction pump 10, then stops the exhaust, and with only the ink feed path 21 corresponding to cyan ink kept in the open state, releases the negative pressure in the closed space (the negative pressure release step). By doing this, the inner pressure of the cap member 13 returns to the atmospheric pressure.

According to the ninth cleaning method, the cap member 13 is exhausted when only the valve unit 30 for the ink kind (cyan) to be cleaned is in the open state and after exhaust stop, continuously with only the ink feed path 21 corresponding to the ink kind to be cleaned kept in the open state, the negative pressure in the closed space is released, so that large negative pressure can be obtained without enlarging the pump, and the suction amount of ink other than the color to be cleaned is suppressed to a small amount, thus a sufficient cleaning effect can be obtained only by a comparatively small amount of ink, and the nozzles of the ink kinds not to be cleaned can be prevented from pull-in of ink or air. By the ninth cleaning method, the suction amount of ink other than the color to be cleaned can be suppressed to an extremely amount.

Figure 14:
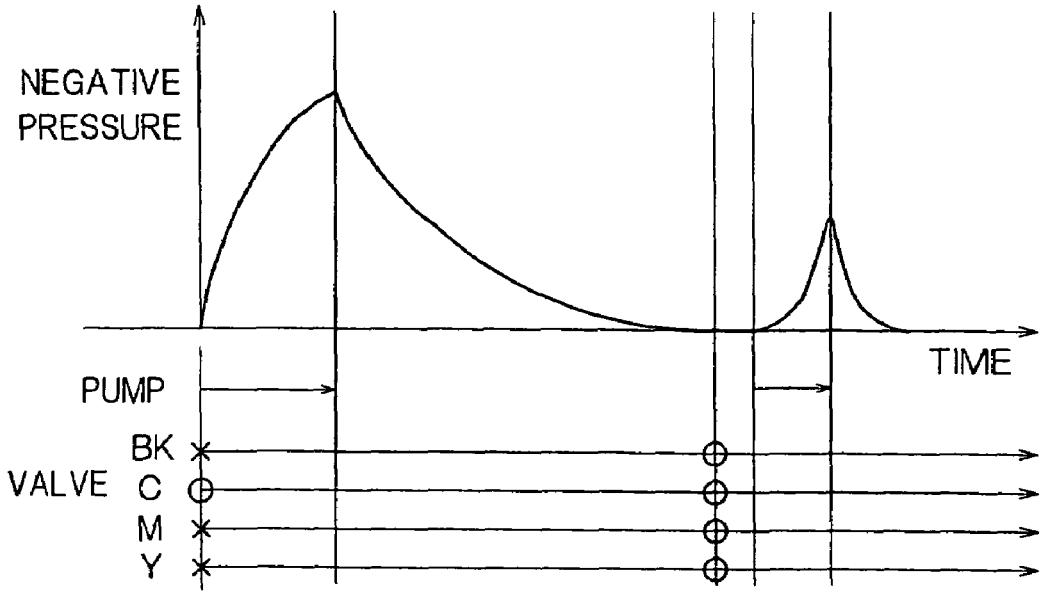
FIG. 14 is a drawing for explaining the tenth cleaning method for the recording head of the ink jet recording apparatus shown in FIGS. 1 and 2.

Next, the tenth cleaning method will be explained by referring to FIG. 14. The tenth cleaning method, at a stage that the closed space in the cap member 13 returns to almost the atmospheric pressure at the negative pressure release step by the ninth cleaning method shown in FIG. 13, switches the valve units 30 in the closed state to the open state and puts the plurality of valve units 30 all into the open state (the totally-opening step). And, after the totally-opening step, with all the plurality of valve units 30 kept in the open state, the method drives the suction pump 10, exhausts the closed space in the cap member 13, thereby sucks all kinds of ink, and then stops the suction pump 10 (the totally-sucking step).

The tenth cleaning method also can obtain the same effect as that of the aforementioned cleaning methods.

Figure 15:
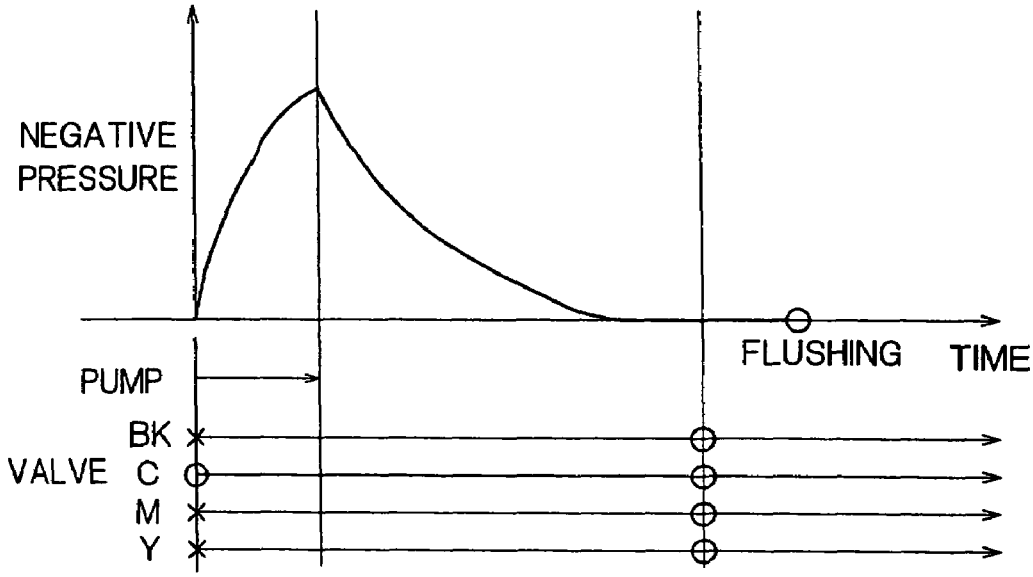
FIG. 15 is a drawing for explaining the eleventh cleaning method for the recording head of the ink jet recording apparatus shown in FIGS. 1 and 2.

Next, the eleventh cleaning method will be explained by referring to FIG. 15. The eleventh cleaning method, in place of the totally-sucking step by the tenth cleaning method shown in FIG. 14, flushes the recording head 12 (the flushing step).

The eleventh cleaning method also can obtain the same effect as that of the aforementioned cleaning methods.

Figure 16:
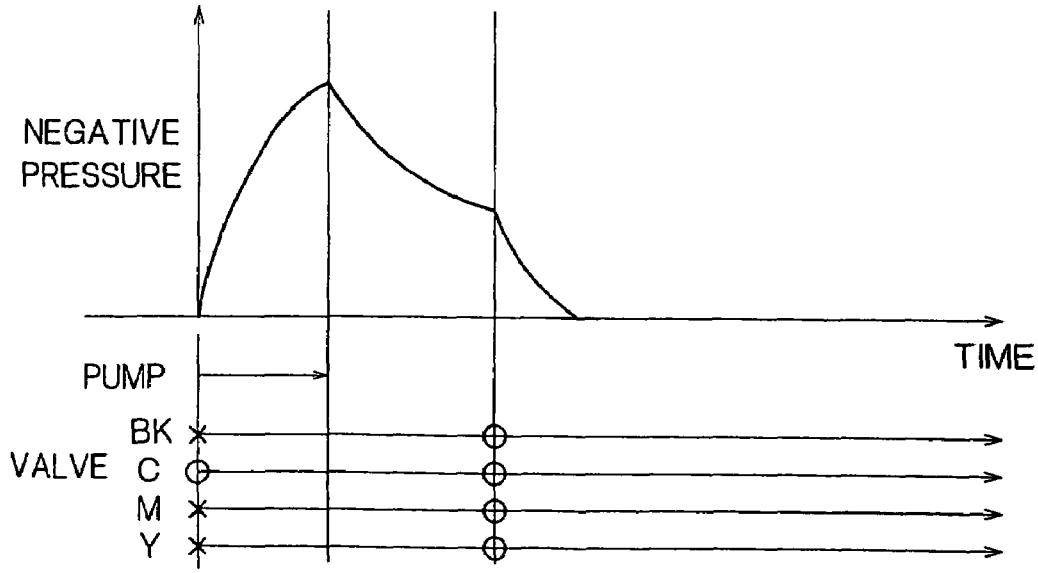
FIG. 16 is a drawing for explaining the twelfth cleaning method for the recording head of the ink jet recording apparatus shown in FIGS. 1 and 2.

Next, the twelfth cleaning method will be explained by referring to FIG. 16. The twelfth cleaning method, at a stage that negative pressure remains in the closed space in the cap member 13 at the negative pressure release step by the ninth cleaning method shown in FIG. 13, switches the valve units 30 in the closed state to the open state and puts all the plurality of valve units 30 into the open state (the totally-opening step).

The twelfth cleaning method also can obtain the same effect as that of the aforementioned cleaning methods.

Figure 17:
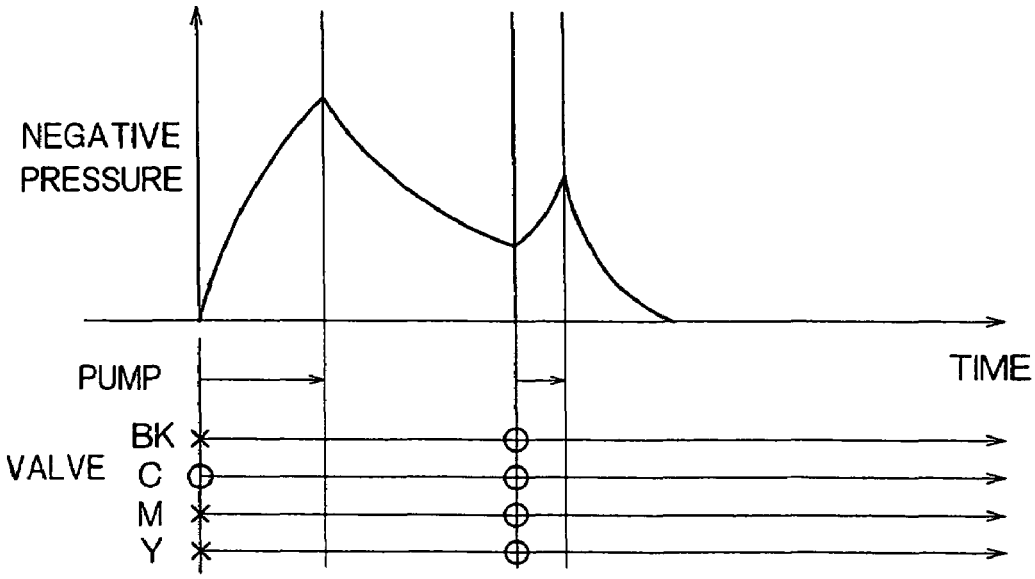
FIG. 17 is a drawing for explaining the thirteenth cleaning method for the recording head of the ink jet recording apparatus shown in FIGS. 1 and 2.

Next, the thirteenth cleaning method will be explained by referring to FIG. 17. The thirteenth cleaning method drives the suction pump 10 almost simultaneously with the totally-opening step by the twelfth cleaning method shown in FIG. 16, exhausts the closed space in the cap member 13, thereby sucks all the kinds of ink, and then stops the suction pump 10 (the totally-sucking step).

The thirteenth cleaning method also can obtain the same effect as that of the aforementioned cleaning methods.

Figure 18:
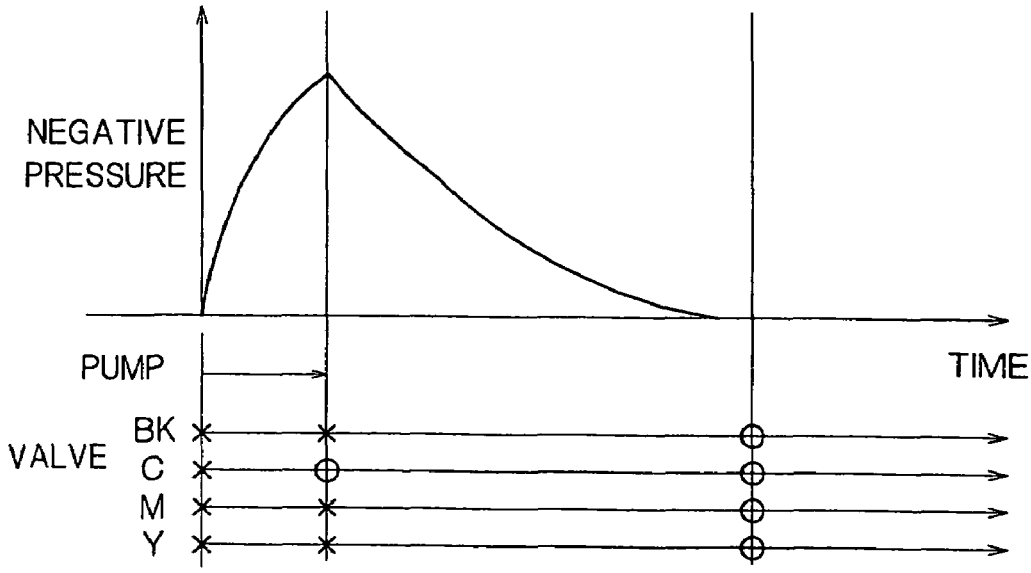
FIG. 18 is a drawing for explaining the fourteenth cleaning method for the recording head of the ink jet recording apparatus shown in FIGS. 1 and 2.

Next, the fourteenth cleaning method will be explained by referring to FIG. 18.

In a state that the nozzle forming face of the recording head 12 is sealed by the cap member 13, the fourteenth cleaning method, using the actuator driving means 52, drives the actuators 35 of the valve units 30 corresponding to black, magenta, yellow, and cyan ink, that is, all colors of ink and closes all the plurality of ink feed paths 21.

The cleaning method puts all the ink feed paths 21 into the closed state like this, sends an instruction from the cleaning control means 47, thereby operates the pump driving means 48, drives the suction pump 10, and sucks ad exhausts the cap member 13 (the pressure reduction step).

And, at the point of time when the negative pressure in the cap member 13 reaches a predetermined level or at the point of time when a predetermined time elapses after start of the suction pump 10, the cleaning control means 4 sends an instruction to the pump driving means 48, thereby stops the suction pump 10, then stops the exhaust, opens only the ink feed path 21 corresponding to the ink kind (cyan) to be cleaned among the plurality of valve units 30, sucks ink, and releases the negative pressure in the closed space in the cap member 13 (the negative pressure release step).

According to the fourteenth cleaning method, the cap member 13 is exhausted when all the valve units are closed, and after stopping exhausting, only the ink feed path 21 corresponding to the ink kind (cyan) to be cleaned is set in the open state, and the negative pressure in the closed space is released, so that large negative pressure can be obtained without enlarging the pump, and the suction amount of ink other than the color to be cleaned is suppressed to a small amount, thus a sufficient cleaning effect can be obtained only by a comparatively small amount of ink, and the nozzles of the ink kinds not to be cleaned can be prevented from pull-in of ink or air. By the fourteenth cleaning method, the suction amount of ink other than the color to be cleaned can be suppressed to an extremely amount.

Figure 19:
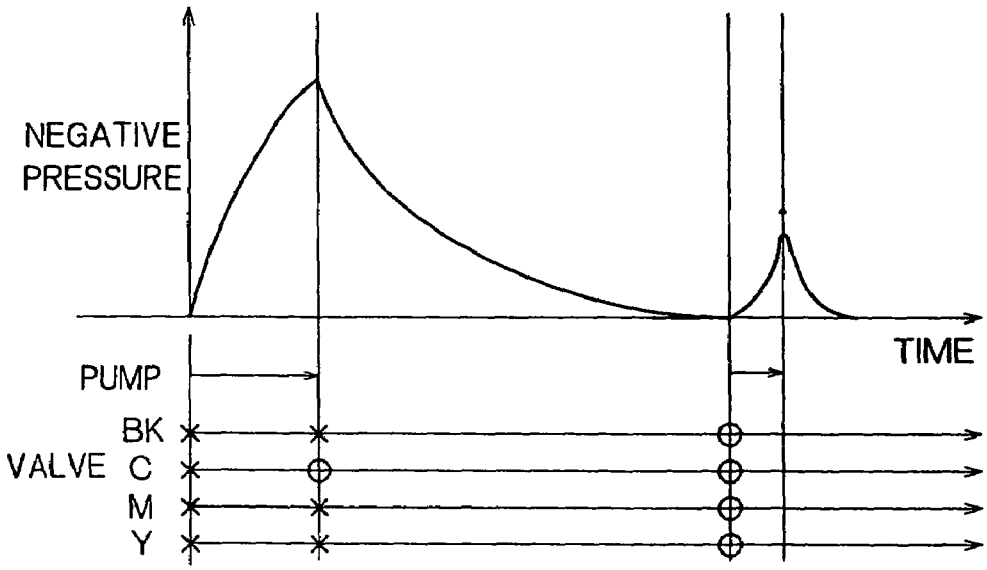
FIG. 19 is a drawing for explaining the fifteenth cleaning method for the recording head of the ink jet recording apparatus shown in FIGS. 1 and 2.

Next, the fifteenth cleaning method will be explained by referring to FIG. 19. The fifteenth cleaning method, at a stage that the closed space in the cap member 13 returns to almost the atmospheric pressure at the negative pressure release step by the fourteenth cleaning method shown in FIG. 18, switches the valve units 30 in the closed state to the open state and puts the plurality of valve units 30 all into the open state (the totally-opening step). And, after the totally-opening step, with all the plurality of valve units 30 kept in the open state, the method drives the suction pump 10, exhausts the closed space in the cap member 13, thereby sucks all kinds of ink, and then stops the suction pump 10 (the totally-sucking step).

The fifteenth cleaning method also can obtain the same effect as that of the aforementioned cleaning methods.

Figure 20:
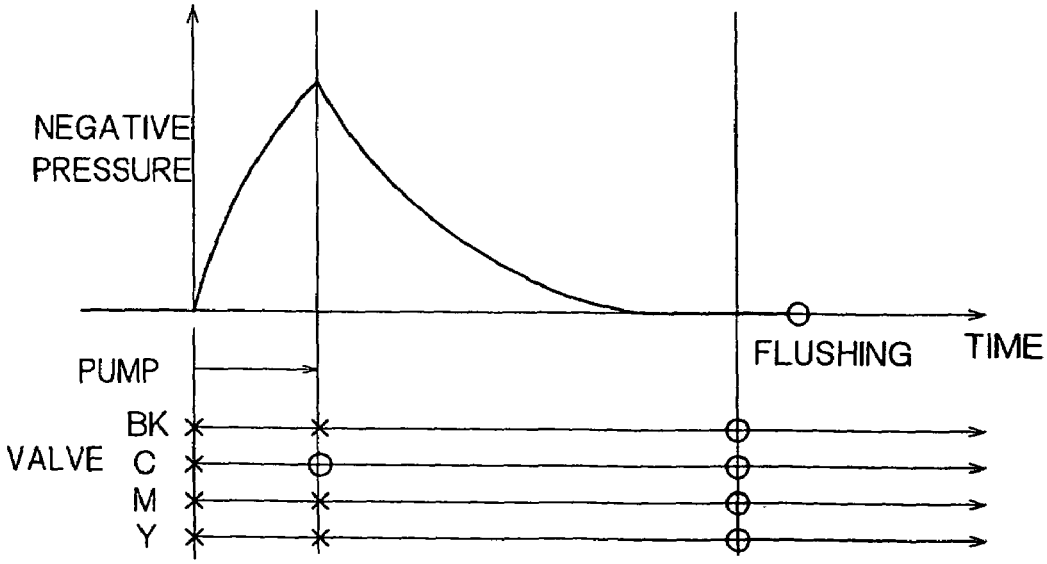
FIG. 20 is a drawing for explaining the sixteenth cleaning method for the recording head of the ink jet recording apparatus shown in FIGS. 1 and 2.
Figure 21:
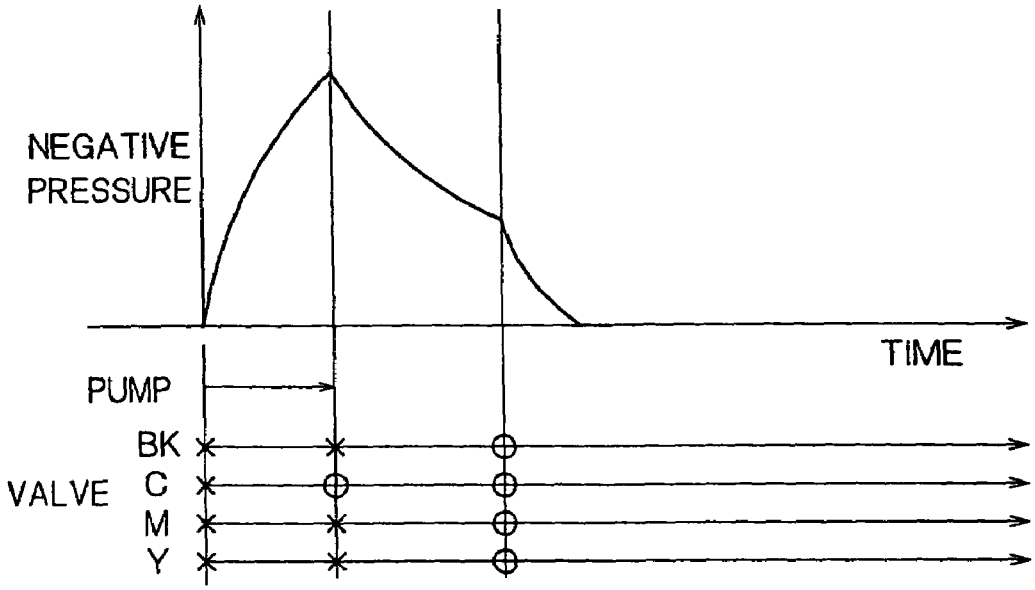
FIG. 21 is a drawing for explaining the seventeenth cleaning method for the recording head of the ink jet recording apparatus shown in FIGS. 1 and 2.

Next, the sixteenth cleaning method will be explained by referring to FIG. 20. The sixteenth cleaning method, in place of the totally-sucking step by the fifteenth cleaning method shown in FIG. 19, flushes the recording head 12 (the flushing step).

The sixteenth cleaning method also can obtain the same effect as that of the aforementioned cleaning methods.

Next, the seventeenth cleaning method will be explained by referring to FIG. 17. The seventeenth cleaning method, at a stage that negative pressure remains in the closed space in the cap member 13 at the negative pressure release step by the fourteenth cleaning method shown in FIG. 18, switches the valve units 30 in the closed state to the open state and puts all the plurality of valve units 30 into the open state (the totally-opening step).

The seventeenth cleaning method also can obtain the same effect as that of the aforementioned cleaning methods.

Figure 22:
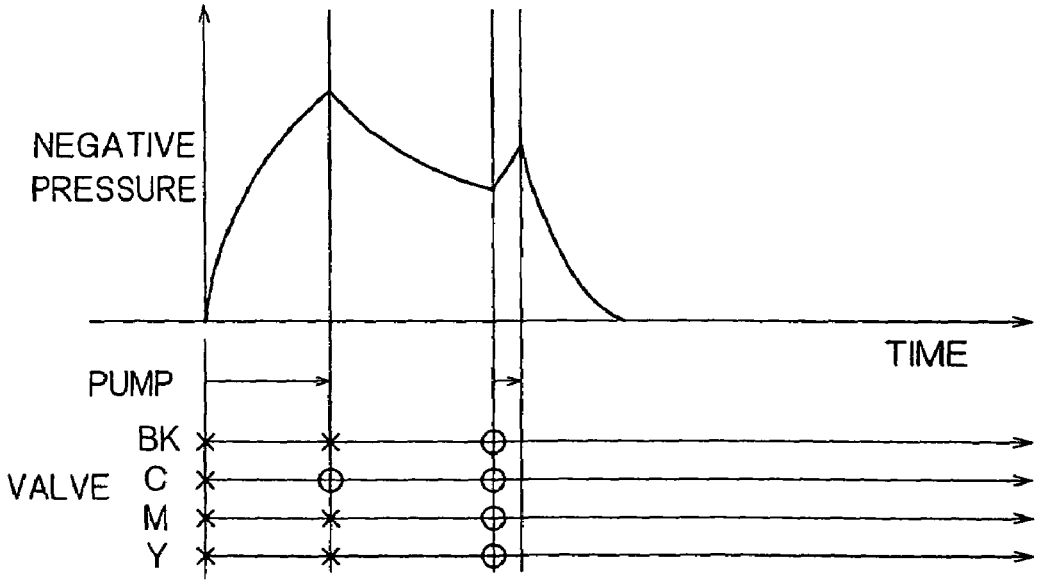
FIG. 22 is a drawing for explaining the eighteenth cleaning method for the recording head of the ink jet recording apparatus shown in FIGS. 1 and 2.

Next, the eighteenth cleaning method will be explained by referring to FIG. 22. The eighteenth cleaning method drives the suction pump 10 almost simultaneously with the totally-opening step in the seventeenth cleaning method shown in FIG. 21, exhausts the closed space in the cap member 13, thereby sucks all the kinds of ink, and then stops the suction pump 10 (the totally-sucking step).

The eighteenth cleaning method also can obtain the same effect as that of the aforementioned cleaning methods.

As described above, according to the present invention, the closed space formed by the capping unit is exhausted under the condition that only the valve unit for the kind of liquid to be cleaned is in the open state, and almost simultaneously with stopping exhausting or immediately before stopping exhausting, the valve unit in the open state is closed, and after a lapse of a predetermined time, all the valve units are opened, so that large negative pressure can be obtained without enlarging the negative pressure generation unit, and the suction amount of ink other than the ink to be cleaned is suppressed to a small amount, thus a sufficient cleaning effect can be obtained only by a comparatively small amount of ink, and the nozzles of the kind of liquid not to be cleaned can be prevented from pull-in of liquid or air.

Further, according to the present invention, the closed space formed by the capping unit is exhausted under the condition that only the valve unit for the kind of liquid to be cleaned is in the open state, and almost simultaneously with stopping exhausting, the valve units in the closed state are opened, so that large negative pressure can be obtained without enlarging the negative pressure generation unit, and the suction amount of ink other than the ink to be cleaned is suppressed to a small amount, thus a sufficient cleaning effect can be obtained only by a comparatively small amount of ink, and the nozzles of the kind of liquid not to be cleaned can be prevented from pull-in of liquid or air.

Further, according to the present invention, the closed space formed by the capping unit is exhausted under the condition that only the valve unit for the kind of liquid to be cleaned is in the open state, and after stopping exhausting, with only the valve unit for the kind of liquid to be cleaned kept in the open state, the negative pressure in the closed space is released, so that large negative pressure can be obtained without enlarging the negative pressure generation unit, and the suction amount of ink other than the ink to be cleaned is suppressed to a small amount, thus a sufficient cleaning effect can be obtained only by a comparatively small amount of ink, and the nozzles of the kind of liquid not to be cleaned can be prevented from pull-in of liquid or air.

Further, according to the present invention, the closed space formed by the capping unit in a state that the valve units are all closed are exhausted, and after stopping exhausting, only the valve unit corresponding to the kind of liquid to be cleaned is put into the open state, and the negative pressure in the closed space is released, so that large negative pressure can be obtained without enlarging the negative pressure generation unit, and the suction amount of ink other than the ink to be cleaned is suppressed to a small amount, thus a sufficient cleaning effect can be obtained only by a comparatively small amount of ink, and the nozzles of the kind of liquid not to be cleaned can be prevented from pull-in of liquid or air.

Although the invention has been described in its preferred embodiment with a certain degree of particularity, obviously many changes and variations are possible therein. It is therefore to be understood that the present invention may be practiced otherwise than as specifically described herein without departing from the scope and spirit thereof.

What is claimed is:

1. A liquid jet apparatus comprising:

a liquid jet head having nozzle openings through which liquid drops are ejected;

a liquid storage unit configured to store plural kinds of liquids to be fed to said liquid jet head;

a plurality of valve units capable of respectively closing a plurality of liquid feed paths interconnecting said liquid storage unit and said liquid jet head for each kind of said plural kinds of liquids;

a capping unit configured to seal a nozzle forming face of said liquid jet head and form a closed space;

a negative pressure generation unit configured to exhaust said closed space formed by said capping unit and generate negative pressure in said closed space; and control means for controlling a switching operation for an open state or a closed state of said plurality of valve units and an exhaust operation for said closed space by said negative pressure generation unit so as to execute cleaning of said liquid jet head, wherein said control means has a function for executing a pressure reduction step of putting a valve unit corresponding to a kind of liquid to be cleaned among said plurality of valve units into an open state and simultaneously putting other valve units into a closed state, and in this state, exhausting said closed space by said negative pressure generation unit and generating a negative pressure state, and a negative pressure release step, after said pressure reduction step, of stopping exhausting by said negative pressure generation unit and releasing said negative pressure in said closed space with only said valve unit corresponding to said kind of liquid to be cleaned kept in said open state, and wherein said control means further has a function, at a stage that negative pressure remains in said closed space at said negative pressure release step, for executing a totally-opening step of switching said other valve units in said closed state into said open state and putting all said plurality of valve units into said open state.

2. A liquid jet apparatus according to claim 1, wherein said control means further has a function for executing a totally-sucking step of starting exhausting of said closed space by said negative pressure generation unit almost simultaneously with said totally-opening step, thereby sucking all kinds of liquids, and then stopping exhausting by said negative pressure generation unit.

3. A cleaning method for a liquid jet head of a liquid jet apparatus including said liquid jet head having nozzle openings through which liquid drops are ejected, a liquid storage unit configured to store plural kinds of liquids to be fed to said liquid jet head, a plurality of valve units capable of respectively closing a plurality of liquid feed paths interconnecting said liquid storage unit and a liquid jet head for each kind of said plural kinds of liquids, a capping unit configured to seal a nozzle forming face of said liquid jet head and form a closed space, and a negative pressure generation unit configured to exhaust said closed space formed by said capping unit and generate negative pressure in said closed space, comprising:

a pressure reduction step of putting a valve unit corresponding to a kind of liquid to be cleaned among said plurality of valve units into an open state and simultaneously putting other valve units into a closed state, and in this state, exhausting said closed space by said negative pressure generation unit and generating a negative pressure state;

a negative pressure release step, after said pressure reduction step, of stopping exhausting by said negative pressure generation unit and releasing said negative pressure in said closed space with only said valve unit corresponding to said kind of liquid to be cleaned kept in said open state; and a totally-opening step of, at a stage that negative pressure remains in said closed space at said negative pressure release step, switching said other valve units in said closed state into said open and putting all said plurality of valve units into said open state.

4. A cleaning method for a liquid jet head according to claim 3, further comprising:

a totally-sucking step of starting exhausting of said closed space by said negative pressure generation unit almost simultaneously with said totally-opening step, thereby sucking all kinds of liquids, and then stopping exhausting by said negative pressure generation unit.

* * * * *